US009086076B2

(12) United States Patent
McCallum et al.

(10) Patent No.: US 9,086,076 B2
(45) Date of Patent: Jul. 21, 2015

(54) VARIABLE PITCH FAN HAVING A PITCH SENSOR

(75) Inventors: Jonathan E. McCallum, Edmonton (CA); Andrew L. Norell, Edmonton (CA); George Antoszko, Edmonton (CA); Mariusz Kloza, Darien, IL (US)

(73) Assignee: Flexxaire Inc., Edmonton, Alberta (CA)

( * ) Notice: Subject to any disclaimer, the term of this patent is extended or adjusted under 35 U.S.C. 154(b) by 565 days.

(21) Appl. No.: 13/516,712

(22) PCT Filed: Dec. 20, 2010

(86) PCT No.: PCT/CA2010/001974

§ 371 (c)(1),
(2), (4) Date: Jun. 15, 2012

(87) PCT Pub. No.: WO2011/072381

PCT Pub. Date: Jun. 23, 2011

(65) Prior Publication Data

US 2012/0263593 A1 Oct. 18, 2012

Related U.S. Application Data

(60) Provisional application No. 61/288,104, filed on Dec. 18, 2009.

(51) Int. Cl.
*F04D 29/36* (2006.01)
*F04D 25/08* (2006.01)

(52) U.S. Cl.
CPC ..... *F04D 29/362* (2013.01); *F04D 25/08* (2013.01); *F05D 2260/74* (2013.01); *F05D 2260/76* (2013.01)

(58) Field of Classification Search
CPC ..... F04D 19/005; F04D 25/08; F04D 29/362; F05D 2260/70; F05D 2260/76; B64C 11/30; B64C 11/38; B64C 11/40; B64C 11/41; B64C 11/301; B63H 2003/084
USPC ..... 416/157 A, 157 R
See application file for complete search history.

(56) References Cited

U.S. PATENT DOCUMENTS

| | | | | |
|---|---|---|---|---|
| 2,355,039 | A * | 8/1944 | Eves | 416/157 R |
| 3,140,475 | A | 7/1964 | Spencer | |
| 3,873,235 | A | 3/1975 | Mendelson | |
| 3,895,883 | A * | 7/1975 | Pedersen | 416/61 |

(Continued)

FOREIGN PATENT DOCUMENTS

| | | | |
|---|---|---|---|
| CA | 2 616 310 | A1 | 7/2009 |
| DE | 100 44 321 | A1 | 3/2001 |

(Continued)

OTHER PUBLICATIONS

"Flexxaire®Engine Temperature Control Systems: Operation & Maintenance Manual," Publication No. 01508, Rev. 1, Flexxaire Manufacturing Inc., Edmonton, Canada, Nov. 1998, pp. 6-5 and 6-25.

*Primary Examiner* — Ninh H Nguyen
(74) *Attorney, Agent, or Firm* — Seed IP Law Group PLLC

(57) ABSTRACT

A compact variable pitch fan has a drive fluid pitch change mechanism. A pitch change piston is constrained to follow reciprocating motion under drive fluid control within a peripheral hub from which fan blades extend outward. A pitch change sensor is mounted with the rotary union.

8 Claims, 2 Drawing Sheets

(56) References Cited

U.S. PATENT DOCUMENTS

| | | | | |
|---|---|---|---|---|
| 4,037,986 | A | 7/1977 | Chilman | |
| 4,668,168 | A | 5/1987 | Schilder | |
| 6,109,871 | A | 8/2000 | Nelson | |
| 6,113,351 | A | 9/2000 | McCallum | |
| 6,190,126 | B1 | 2/2001 | Hägele | |
| 6,253,716 | B1 | 7/2001 | Palmer | |
| 6,439,850 | B1 | 8/2002 | McCallum | |
| 6,644,922 | B2 | 11/2003 | McCallum | |
| 6,767,187 | B2 * | 7/2004 | Franchet et al. | 416/157 R |
| 6,942,458 | B2 | 9/2005 | McCallum | |
| 7,229,250 | B2 | 6/2007 | McCallum | |
| 7,670,114 | B2 | 3/2010 | McCallum | |
| 7,874,801 | B2 * | 1/2011 | Schmidt | 416/156 |
| 8,197,214 | B2 | 6/2012 | McCallum | |
| 2006/0086086 | A1 * | 4/2006 | Syse et al. | 60/325 |
| 2012/0240878 | A1 | 9/2012 | Hägele | |

FOREIGN PATENT DOCUMENTS

| | | | |
|---|---|---|---|
| DE | 202 16 802 | U1 | 3/2003 |
| DE | 199 59 893 | B4 | 7/2004 |
| DE | 10 2004 035 631 | B4 | 2/2006 |
| EP | 0 972 129 | B1 | 1/2003 |
| EP | 0 945 626 | B1 | 12/2004 |
| GB | 2 260 821 | A | 4/1993 |

* cited by examiner

VARIABLE PITCH FAN HAVING A PITCH SENSOR

CROSS-REFERENCE TO RELATED APPLICATIONS

This application is a National Stage of International Application No. PCT/CA2010/001974, filed Dec. 20, 2010, which claims the benefit of U.S. Provisional Application No. 61/288,104, filed Dec. 18, 2009.

BACKGROUND

Flexxaire Manufacturing Inc. of Edmonton, Canada, manufactures a variable pitch fan. This fan is predominantly used to cool industrial diesel engines. The pitch of the blades are adjusted to control both the direction and the amount of airflow generated by the fan. The primary benefits of controlling the airflow are two fold: Reversing the airflow allows debris to be blown off the radiator to reduce or eliminate overheating caused by clogged radiator. The second primary benefit is the ability to provide airflow on demand. This allows the fan to only blow as much air as required to cool the engine thereby reducing the parasitic horsepower draw of the fan resulting in either fuel savings or higher machine productivity as the saved horsepower becomes available for productivity increase. Examples of Flexxaire fans are shown in FIGS. 1 and 2 of U.S. Pat. No. 7,229,250 issued Jun. 12, 2007.

Flexxaire has offered fans where the actual pitch is not measured or known, but the pitch control system monitors fluid temperatures and adjusts pitch as follows: If any temperature is higher than desired, increase the pitch in stepped increase. If all temperatures are below the desired temperature, decrease the pitch in a stepped amount. If all temperatures are within acceptable parameters do not adjust pitch. This control scheme is a closed loop control scheme where the control is closed on fluid temperatures and the pitch is not known. A design of a Flexxaire fan with a pitch change system is shown in US published application no. 20090196747 published Aug. 6, 2009.

This system has worked effectively, but there are a number of deficiencies that can only be resolved when actual pitch is known, and therefore a pitch sensor is desirable. The challenge with developing a pitch sensor is that the entire fan is rotating at high speeds except for the shaft on the rotary union. Therefore to measure the pitch of the rotating fan presents challenges of obtaining information for a rotating frame of reference to a stationary frame.

SUMMARY

In an embodiment, a compact variable pitch fan has a drive fluid pitch change mechanism. A pitch change piston is constrained to follow reciprocating motion under drive fluid control within a peripheral hub from which fan blades extend outward. A pitch change sensor is formed at least partly as part of the rotary union, for example with parts of the pitch change sensor within the rotary union. In an embodiment, the pitch change sensor comprises a pin and a coil, one of the pin and coil being connected to move with the pitch change piston and the other of the pin and coil being formed within the rotary union.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which.

DETAILED DESCRIPTION

In the claims, the word "comprising" is used in its inclusive sense and does not exclude other elements being present. The indefinite article "a" before a claim feature does not exclude more than one of the feature being present. Each one of the individual features described here may be used in one or more embodiments and is not, by virtue only of being described here, to be construed as essential to all embodiments as defined by the claims.

A compact variable pitch fan achieves pitch change by using a drive fluid under pressure (hydraulic oil or air for example) to stroke single acting spring return piston along the axis of fan rotation. The blade shafts are interlocked with the piston in such a way that the axial translation of the piston results in a rotation of the blade shafts. The fluid is transmitted to the rotation fan by way of a rotary union. The fluid supply line attaches to the stationary non rotating rotary union shaft. The remaining components of the rotating union rotate with the fan.

A novel solution of integrating a circuit board and measurement coil into the rotary union shaft is presented here. On the pitch adjustment piston, a pin is attached. This pin is rotating with the fan, but the rotating union shaft is stationary. As pitch change occurs, the measurement pin travels axially inside a measurement coil, and thereby changes the inductance of the coil. By measuring the inductance change of the coil, one can determine the insertion depth of the measurement pin, and therefore the axial position of the piston which correlates to a particular blade pitch. The measurement coil is exposed to high pressure hydraulic oil, and so a suitable means of getting the wires from the measurement coil to the circuit board (which is not exposed to high pressure hydraulic oil) is implemented. The wires protrude through a galley that is filled with a suitable potting compound that will seal to the wires and can withstand hydraulic pressure.

Figure 1:
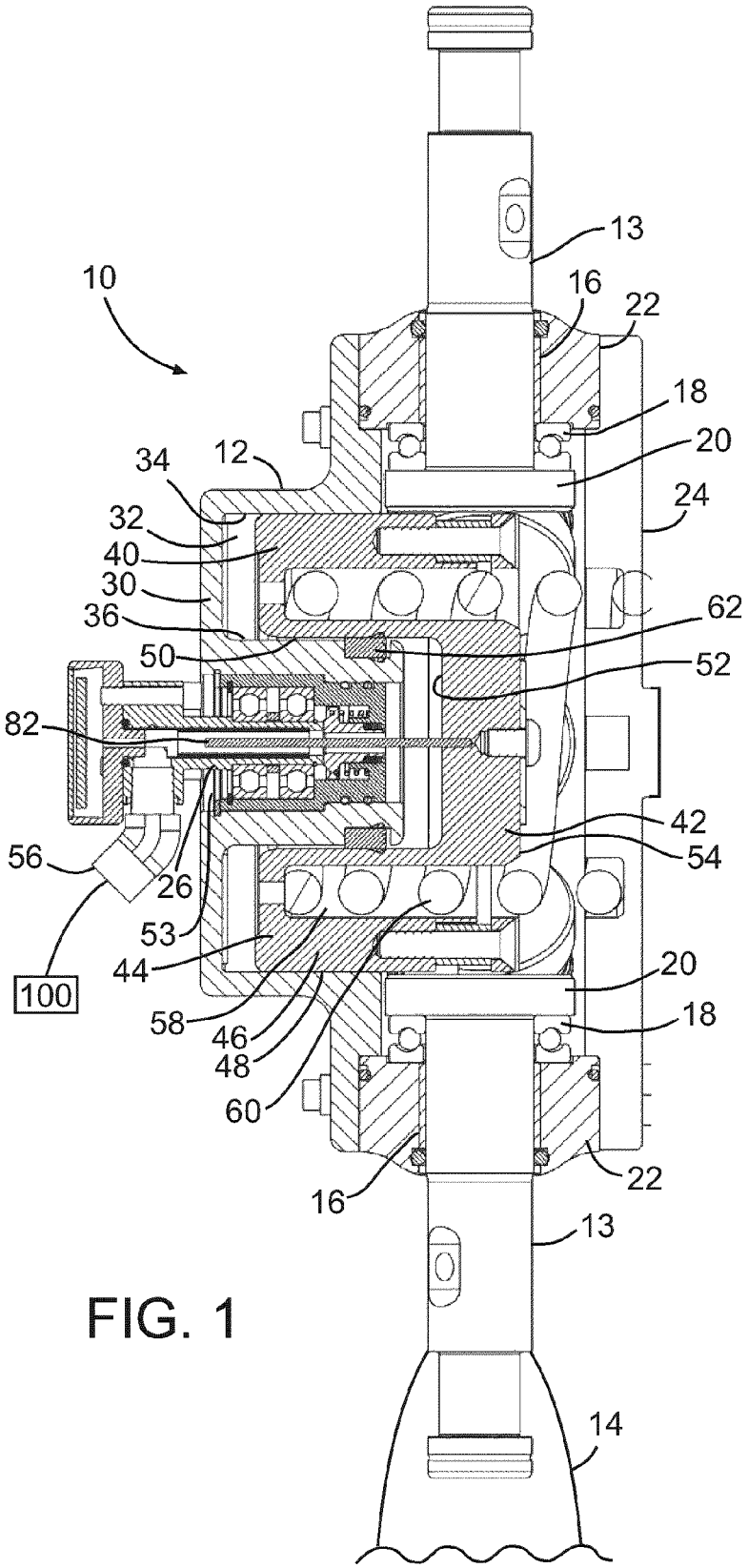
FIG. 1 is a section through a variable pitch fan showing a pitch change mechanism within a rotary union.

An exemplary embodiment of a compact variable pitch fan will now be described. As shown in FIG. 1, a variable pitch fan 10 has a peripheral hub 12 in which blade shafts 13 of fan blades 14 are journalled and extend outward in conventional fashion. For each fan blade 14, a bushing 16 and bearings 18 allow the fan blade 14 to rotate at least partially around a radially extending axis passing through the fan blade 14. The fan blade 14 terminates radially inward in a fan blade connector piece 20. The fan blade 14 will typically rotate between normal and reverse pitch, and pass through a continuous range of possible positions between normal and reverse, including a neutral position in which the fan blades 14 are parallel to the plane of rotation of the fan blades 14. Attached to a back side 22 of the peripheral hub 12 by any suitable means is a back or mounting plate 24. The mounting plate 24 permits the variable pitch fan 10 to be mounted directly on a rotating part of an engine (not shown), typically of a piece of heavy machinery, so that the entire variable pitch fan rotates together, apart from a rotary union 26.

A front plate 30 is secured by any suitable means to the front side of the peripheral hub 10. One or more of the peripheral hub 12, mounting plate 24 and front plate 30 together form a housing that defines a cylinder having an annular cylinder portion 32. In the example shown, the peripheral hub 12, mounting plate 24 and front plate 30 all cooperate to define the cylinder, but this is not necessary. An outer cylindrical wall 34 of the front plate 30 and inner cylindrical wall 36 together form walls of the annular cylinder portion 32. A pitch change piston 40 is mounted within the cylinder. The pitch change piston 40 is closed at one end 42 and on its other end 44, which is received within the annular cylinder portion 32, there is an annular piston portion 46 formed between an outer piston wall 48 and an inner piston wall 50. Various drive configurations may be used to drive the pitch change piston 40. In the example shown, the pitch change piston 40 has a driven side 52 and a return side 54. While the parts 12, 24 and 30 together form a housing in this embodiment, other configurations of housing are possible, such as including changes of shape, configuration, orientation or number of parts.

The rotary union 26 is housed within the inner cylindrical wall 36, and provides a drive fluid supply to the driven side 52 of the pitch change piston 40. The rotary union 26 may be secured in place by any suitable means such as a spiral spring 53. In use, a drive fluid line 56 is connected to the rotary union 26. The drive fluid line 56 runs out to a drive fluid control system 100. The control system 100 may be designed according to the principles described in U.S. Pat. No. 7,229,250 issued Jun. 12, 2007. The rotary union 26 is designed as shown and described in relation to FIG. 3 to allow the drive fluid line 56 to remain fixed, while the variable pitch fan 10 rotates. In addition, the rotary union 26, particularly its internal parts, is designed to act as a pitch sensor. The annular piston portion 46 has an annular slot 58 on the return side 54 of the pitch change piston 40 in which lies a return spring 60. The return spring 60 presses up against the return side 54 of the pitch change piston 40 deep within the slot 58 and against the mounting plate 24 to bias the pitch change piston 40 to the front side of the variable pitch fan 10, as shown in FIG. 1, which may correspond to a normal blade position. Application of drive fluid fluid through the rotary union 26 into the space between the front plate 24 and the closed end 42 of the pitch change piston 40 urges the pitch change piston 40 against the force of the return spring 60 towards the position shown in FIG. 2, which may for example correspond to a reverse pitch position of the fan blades. A double acting piston could also be used as a return drive, but is not as simple to make as a return drive using a return spring 60.

The outer cylindrical wall 34 may form a guide surface or guiding wall for the pitch change piston 40. That is, the dimensions of the outer piston wall 48 and the inner cylindrical wall 34 may be chosen so that the outer piston wall 48 fits as closely as possible to the inner cylindrical wall 34 while allowing motion of the pitch change piston 40 within the cylinder. To avoid damage to a seal along the guide surface, drive fluid fluid injected between the front plate 30 and closed end 42 of the pitch change piston 40 is prevented from migrating out of the cylinder by an annular seal 62 the inner cylindrical wall 36 and the inner piston wall 50. The annular seal 62 may for example be a U-seal.

Figure 2:
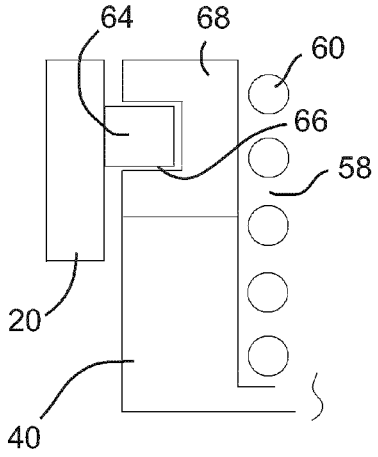
FIG. 2 shows a design of a fan blade interconnection mechanism.

As shown in FIG. 2, the pitch change piston 40 interconnects with the fan blades 14 to control pitch of the fan blades 14 by any suitable means, such as a pin 64 extending from the fan blade connector piece 20 into a receiving socket 66 in a shifter block 68 that forms part of the pitch change piston 40 and is secured to the other parts of the pitch change piston 40 by for example cap screws 70 and spacers 72.

In operation, the variable pitch fan 10 is in its normal operating position with the fan blades 14 in full normal pitch (corresponding to cooling). The example in FIG. 1 shows the pitch change piston 40 in a neutral position. Full normal pitch may for example correspond to the pitch change piston 40 being fully driven to the left in FIG. 1. When a pitch change is desired, drive fluid fluid, for example hydraulic fluid, may be pulsed through the rotary union 26 in an integral control scheme. Incrementally adding fluid in a series of pulses between the front plate 30 and closed end 42 of the pitch change piston 40 incrementally alters the pitch of the fan blades 14 towards full reverse thrust. Any desired operating position may be chosen depending on the amount of drive fluid fluid pulsed through the rotary union 26. For example, each pulse may correspond to a pitch change of one degree. Other methods of changing pitch with flow of drive fluid fluid may also be used.

Figure 3:
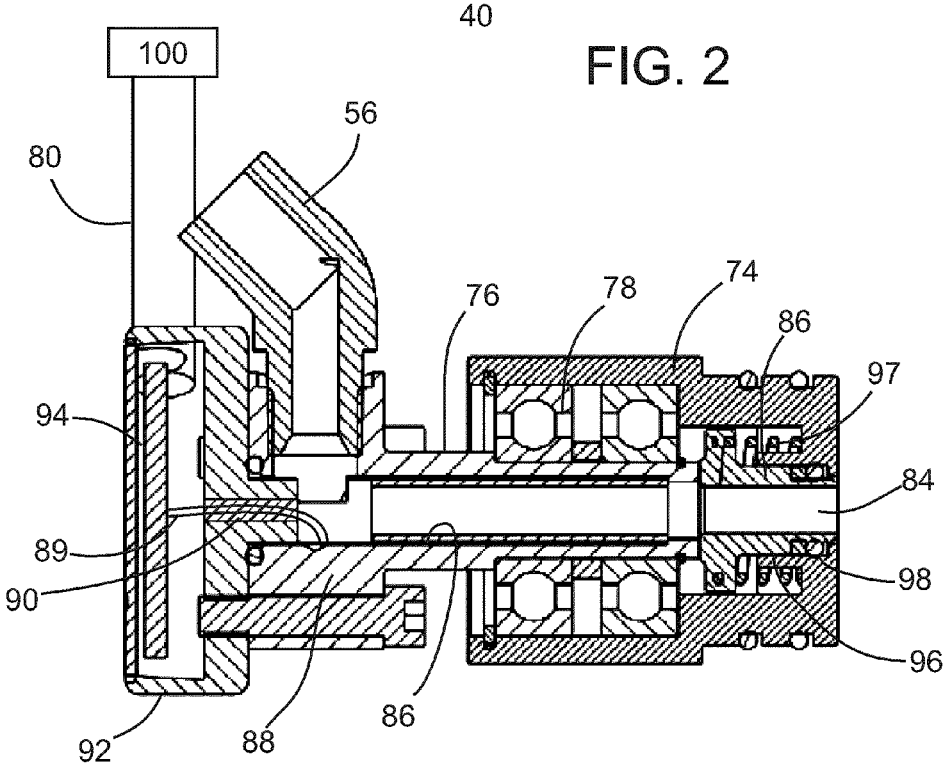
FIG. 3 shows further detail of a rotary union.

Variations of the basic design shown here may be used for the variable pitch fan. An example variation of the seal, where the seal 62 is replaced by a seal on the guiding wall 34 is shown in FIG. 3 of US published application no. 20090196747. While this design risks damage to the seal in the guiding wall 34, it has the added advantage of allowing for lower drive fluid pressure due to the larger diameter. There is a corresponding trade-off of increasing the amount of hydraulic fluid required, which may not be desired.

During operation, it is sometimes useful to know the exact position of the fan blades 14. For example, after a purge, when the fan blades 14 are driven by drive fluid fluid into full reverse position, it may be desirable to return the fan blades 14 to the position that the fan blades 14 were in prior to the purge. A pitch sensor may be used for this purpose. In one embodiment shown in FIGS. 1 and 3, the pitch sensor is incorporated at least partly within the rotary union 26. The rotary union 26 comprises a housing 74 that is secured within the inner cylindrical wall 36, and a non-rotating portion 76 mounted on bearings 78 within the housing 74. In operation of the variable pitch fan 10, the housing 74 rotates with the components of the variable pitch fan other than the stationary part of the rotary union 26, the drive fluid line 56 and any cables such as cable 80 connected to the pitch sensor. The pitch sensor in the embodiment shown is conveniently located on the drive fluid supply comprising line 56 as it enters the rotary union 26.

The pitch sensor is formed in the embodiment shown by a metallic pin 82 that is fixed to the pitch change piston 40 and protrudes along the rotation axis of the fan 10 into the rotary union 26. The pin 82 extends into a passage 84 within the rotary union 26 that is used as part of the drive fluid supply into the annular cylinder portion 32. The pin 82 extends sufficiently far into the rotary union 26 to enter a coil 86 formed around at least a portion of the passage 84. In the exemplary embodiment of FIG. 3, the passage 84 is defined by a rotating sealing element 86 and a non-rotating sleeve 88. The coil 86 in this case is formed in the non-rotating sleeve 88. The coil 86 may also be formed within a rotating part of the rotary union 26, but this complicates the electrical connections and is not preferred.

The coil 86 is connected by wires 89 through an extension 90 of the passage 84 that is contained within the non-rotating part of the rotary union 26. The extension 90 is formed in FIG. 3 as a bore in an end cap 92 of the rotary union 26 and is potted a suitable potting compound to provide a fluid tight seal against drive fluid escaping the passage 84 where the wires 89 exit the passage 84. The wires 89 terminate at a pitch sensor circuit board 94 housed within the end cap 92. The pitch sensor circuit board 94 connects by the cables 80 to any suitable control mechanism 100 for controlling the pitch of the blades of the variable pitch fan.

The sealing element 86 of the rotary union 26 is formed of a sleeve 96 fitted into the housing 74 with seals 98 between the housing 74 and sleeve 96 to retain drive fluid in the passage 84. A spring 97 urges the sleeve 96 towards face-to-face contact with the sleeve 76 and forms a face seal at their contact point. Conventional methods may be used to hold the parts together, such as split rings.

The drive fluid control system 100 includes an electronic controller and a valve or set of valves that control fluid delivered to drive fluid line 56. The control system 100 is itself conventional, and may be such as shown in FIG. 7 of US publication no. 20090196747. The valves could be any of the configurations shown in FIGS. 3-11 of U.S. Pat. No. 7,229,250 or other suitable valves to achieve control of fluid to the variable pitch fan. In one embodiment, the valves may deliver fluid pulses through line 56 and the pitch sensor. Sensor signals from the pitch sensor are sent back to the controller on line 80. The controller of the control system 100 can be a dedicated electronic device, or a virtual device: an existing programmable controller can be programmed to directly control the valves (for example, the ECM—engine control module of a conventional vehicle).

There are a number of parameters that affect the cooling requirements of a machine, and therefore the required pitch of the fan. The types and numbers of parameters vary from machine to machine depending on which systems are cooled by the fan (i.e. Air conditioner condenser, hydraulic oil cooler, air to air after cooler, engine coolant etc.). Some machines have ECMs (electronic control modules) that already measure all of these parameters and this information can be tapped into. Some machines have fan speed outputs to control the speed of variable speed fans. This output takes into account all the appropriate parameters. Because of the variety, different types of control can be used.

There are a variety of inputs that can be used for the controller of the control system 100. These can be used individually, or in conjunction with each other, for example: A. The input may be an analog input such as temperature sensors (these are sensors that would be used exclusively by the fan control—i.e. they need to be installed with the control system) that could measure for example intake air temperature, coolant temperature, etc, pressure sensors (these are sensors that would be used exclusively by the fan control—i.e. they need to be installed with the control system), air pressure in fan control line or AC condenser core pressure. B. The input may be a control signal such as a PWM fan drive signal. Many engine manufacturers have programmed a PWM fan speed signal that is used on many an drives. This may be used to control the pitch by using an algorithm that converts this proportional signal to an integral signal—for example use a setpoint of 80% of fan speed. If you are below that, increase pitch, if you are above, decrease pitch. C. The input may be a digital input such as from temperature switches instead of temperature sensors, AC compressor input—a digital signal that indicates the AC compressor is running, a backup alarm input (to suppress purges), a fire suppression input, an operator input such as manual purge button, or ECM/Can bus inputs. ECM/Can bus inputs form a communication link. This allows data to be shared from other electronic devices eliminating the requirement for redundant sensors. For example, most ECM's monitor engine temperature. By connecting to the ECM, the control system would not need its own dedicated engine temperature sensor. Other digital inputs include a J1939 Can interface (or the diagnostic port) to capture sensor data, a direct ECM interface, other controllers existing on the equipment on which the fan is used, an IQAN hydraulic controller, or a transmission controller.

The outputs of the controller of the control system 100 may include 2 or 3 digital solenoid driver outputs (depending on the valve configuration) and an optional digital output to indicate when the fan is purging (i.e. connect a dash light to the controller). The controller can either be a virtual device (a program running on an existing programmable controller) or a dedicated electronic device. It will determine the pitch requirements by looking at sensor data. The sensor data is obtained from the pitch sensor formed as part of the rotary union 26 along one or more lines 80. The controller will then adjust the pitch of the fan by pulsing the appropriate valves, by sending signals along conventional connectors, as for example according to the principles of operation described in U.S. Pat. No. 7,229,250, but other methods could be used. Variations of the control system will be applicable to some machines where as other variations will be applicable to others: Large OEMS (for example Caterpillar) will use the virtual controller to save cost and complexity, whereas smaller OEMs may not have the capability to reprogram an engine ECM, and will therefore require a separate device.

Immaterial modifications may be made to the embodiments described here without departing from what is covered by the claims.

What is claimed is:

1. A variable pitch fan, comprising:

a hub defining a cylinder and having a pitch change piston within the cylinder, the pitch change piston having a driven side and a return side;

blades mounted around the hub, the blades being interconnected with the pitch change piston for changing the pitch of the fan blades;

a rotary union mounted on the hub for delivery of drive fluid to the pitch change piston; and a pitch sensor formed at least partly as part of the rotary union;

in which:

the pitch sensor is formed by cooperating first and second parts, the first part being mounted for movement with the pitch change piston and the second part being mounted within the rotary union;

the rotary union comprises a passage through which drive fluid is delivered to the driven side of the pitch change piston; and the cooperating first and second parts of the pitch sensor are formed within the passage.

2. The variable pitch fan of claim 1 in which the first part comprises a pin and the second part comprises a coil.

3. The variable pitch fan of claim 1 in which the pitch sensor comprises a circuit board housed in a non-rotating part of the rotary union.

4. A variable pitch fan, comprising:

a peripheral hub having a front side and a back side;

a mounting plate on the back side of the peripheral hub;

fan blades extending radially outward from the peripheral hub;

a front plate on the front side of the peripheral hub;

one or more of the peripheral hub, mounting plate and front plate defining a cylinder having an annular cylinder portion;

the annular cylinder portion having an outer cylindrical wall and an inner cylindrical wall;

a pitch change piston mounted within the cylinder, the pitch change piston having an annular piston portion with an outer piston wall and an inner piston wall, the pitch change piston having a driven side and a return side;

the pitch change piston interconnecting with the fan blades to control pitch of the fan blades;

a rotary union housed within the inner cylindrical wall, the rotary union providing a drive fluid supply to the driven side of the pitch change piston;

a piston return drive on the return side of the pitch change piston; and a pitch sensor formed at least partly as part of the rotary union.

5. The variable pitch fan of claim 4 in which the pitch sensor is formed by cooperating first and second parts, the first part being mounted for movement with the pitch change piston and the second part being mounted within the rotary union.

6. The variable pitch fan of claim 5 in which:

the drive fluid supply comprises a fluid supply line coupled to the rotary union;

the rotary union comprises a passage through which drive fluid is delivered to the annular cylinder portion; and the cooperating first and second parts of the pitch sensor are formed within the passage.

7. The variable pitch fan of claim 6 in which the first part comprises a pin and the second part comprises a coil.

8. The variable pitch fan of claim 4 in which the pitch sensor comprises a circuit board housed in a non-rotating part of the rotary union.

* * * * *